US006554988B1

(12) United States Patent
Dahms et al.

(10) Patent No.: US 6,554,988 B1
(45) Date of Patent: Apr. 29, 2003

(54) ELECTRIC DIP COATING

(75) Inventors: Johannes Dahms, Wetter (DE); Eberhard Heinemann, Wetter (DE)

(73) Assignee: ITC Holding GmbH, Markgöningen (DE)

( * ) Notice: Subject to any disclaimer, the term of this patent is extended or adjusted under 35 U.S.C. 154(b) by 0 days.

(21) Appl. No.: 09/831,137

(22) PCT Filed: Jul. 16, 1998

(86) PCT No.: PCT/EP98/04454

§ 371 (c)(1),
(2), (4) Date: Feb. 8, 2002

(87) PCT Pub. No.: WO99/04064

PCT Pub. Date: Jan. 28, 1999

(30) Foreign Application Priority Data

Jul. 19, 1997 (DE) ..... 197 31 101

(51) Int. Cl.[7] ..... C25D 13/12
(52) U.S. Cl. ..... 204/488

(58) Field of Search ..... 204/484, 486–488, 204/622–624

(56) References Cited

U.S. PATENT DOCUMENTS 3,879,277 A * 4/1975 Guzzetta et al. ..... 204/623

* cited by examiner

*Primary Examiner*—Kishor Mayekar
(74) *Attorney, Agent, or Firm*—Sidley Austin Brown & Wood, LLP

(57) ABSTRACT

A method for the electro-dipcoating of electrically conductive elements, such as screws, nuts, shims or other hardware includes positioning of the elements, which are to be coated, in, on, or at a supporting element on a coating bath, which is provided with at least one anode and one cathode where on the case of a cathodic electrophoretic enameling, the anode and, in the case of an anodic electrophoretic enameling, the cathode is coated with an enamel, which was baked after the coating process and subsequently activated and/or coated with an electrically conductive enamel, which was subsequently cured at room temperature.

13 Claims, 1 Drawing Sheet

ELECTRIC DIP COATING

This application is a 35 U.S.C. 371 National Stage filing of PCT/EP98/04454, filed on Jul. 16, 1998.

OUTLINE OF THE INVENTION

The invention relates to a method for the electro-dipcoating of electrically conductive elements, such as screws, nuts, shims or other hardware, the elements, which are to be coated, being positioned in, on or at a supporting element in a coating bath, which is provided with at least one anode and one cathode.

BACKGROUND INFORMATION AND PRIOR ART

Different procedures are known for electro-dipcoating or electrophoretic enameling. Frequently, the metallic supporting elements must be cleaned after the treatment, so that an electrically conducting, active, metallic surface is exposed once again. A series of disadvantages are associated with this. In particular, large amounts of electrophoretic enamel, which may be regarded as a valuable material, are wasted. The cleaning, which is usually carried out with solvents, is comparatively costly and expensive and, moreover, time-consuming, especially when it is carried out sealed off from the environment.

OBJECT OF THE INVENTION

It is therefore an object of the invention to provide a solution, with which electro-dipcoating can be carried out with anodes and cathodes and supporting elements which, after taking up electrophoretic enamel for a firsttime, can be used further without a prior cleaning and without taking up electrophoretic enamel once again after the subsequent, repeated use.

SUMMARY OF THE INVENTION

This objective is accomplished with a method of the type described above owing to the fact that, in the case of a cathodic electrophoretic enameling, the anode and, in the case of an anodic electrophoretic enameling, the cathode is coated with an enamel, which was baked after the coating process and subsequently activated and/or coated with an electrically conductive enamel, which was subsequently cured at room temperature.

The advantage of the present invention lies therein that the anode and the cathode are activated with an electrophoretic enamel in such a manner, that they are subsequently conductive equally well for DC as well as for AC currents of different voltages.

In a development, the anode and cathode and/or the supporting element are coated with a cathodic or anodic electrophoretic enamel with a voltage, until the current no longer flows. Subsequently, the enamel is baked or cured at room temperature and, after that, the coating of the objects is activated by applying a DC or AC voltage. In a further development, the supporting element, after it is coated with electrophoretic enamel, is equipped with the object that is to be coated, brought into the eletrophoretic enamel and, while the object is being coated, exposed to a few high current surges, especially dc current surges, for the activation.

It is advantageous if, as is also provided for in the invention, the electrophoretic or coating enamels contain a proportion of electrically conducting materials, such as graphite or a metal.

Corrosion protection can also be provided pursuant to the invention. Such a method is distinguished owing to the fact that the anodes or cathodes, before the enameling or the electro-dipcoating and the subsequent activation of the coating, previously are coated first with a material providing corrosion protection, such as a zinc dust paint.

Pursuant to the invention, it is possible to operate the anodes or cathodes, depending on the procedure, freely in the coating basin, that is, outside of a dialysis cell, although the invention alternatively also provides for the use of such a cell.

Aside from conventional, known metallic anodes and cathodes and also metallic supporting elements, these elements can also be constructed pursuant to the invention as plastic elements, which are provided with metallic coatings before the electro-dipcoating and then are used in the inventive method.

It has turned out to be particularly advantageous to carry out the coating process at 20 to 500 V dc and to carry out the activation with current surges of up to 1,000 V. A drum or a basket can be used as supporting element for bulk material or a frame for suspending articles that are to be coated.

In order to make continuous processing feasible, it is also possible to use a coating belt, which has been enameled and activated according to the inventive procedure.

Advisably, the supporting elements for the activation can be provided with very densely packed electrically conductive objects, as is also provided for in a further development of the invention.

The novel features of the present invention, which are considered as characteristic for the invention, are set forth in the appended claims. The invention itself, however, both as to is construction and its mode of operation, together with additional advantages and objects thereof, will be best understood from the following detailed description of preferred embodiments, when read with reference to the accompanying drawings.

DETAILED DESCRIPTION OF THE PREFERRED EMBODIMENTS

Figure 1:
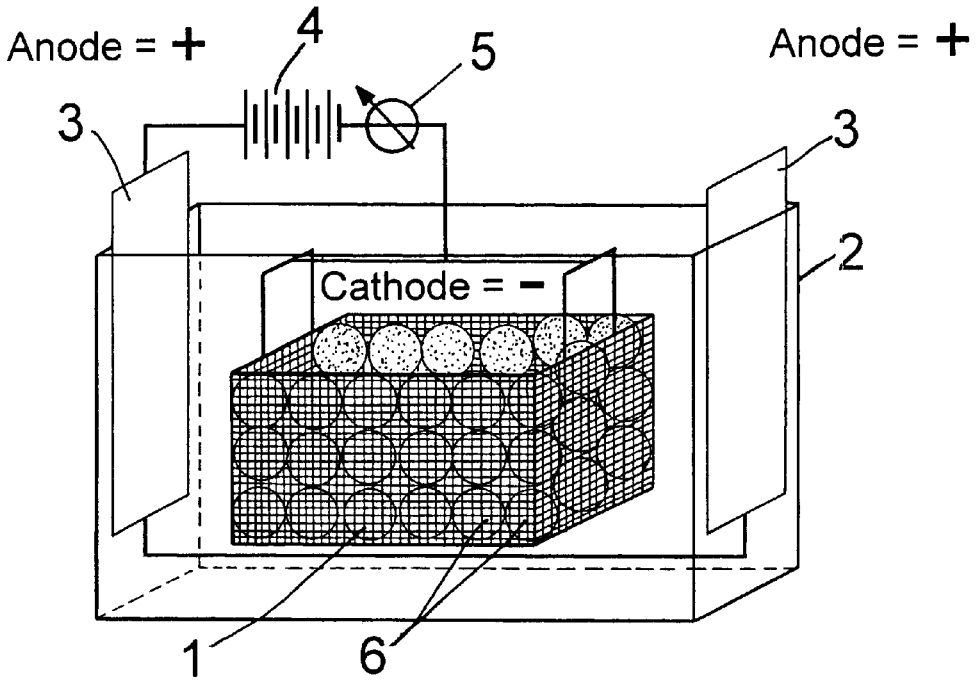
FIG. 1*a* simplified schematic view of a cathodic dipcoating device according to the present invention.

In FIG. 1, an electrically conductive immersion basket 1 is shown. It is connected as a cathode. It contains the material 6 to be coated, which is shown as spheres. The walls of the basin are equipped with anodes 3. Over a source of DC current 4, which is only indicated, it is possible to apply, for example, a DC current of 20 V for a prolonged time and, over a control device of 5, it is possible to supply high current surges of the order of 1,000 V to the basket 1, in order to activate the layer of immersion paint, deposited on the surface of the basket, so that it permanently remains electrically conductive in the subsequent treatment steps, that is, so that it can function as a cathode. The anodes 3 can be coated in the same way and the surface activated correspondingly. FIG. 1 shows cathodic, electrophozetic enameling (KEE).

Figure 2:
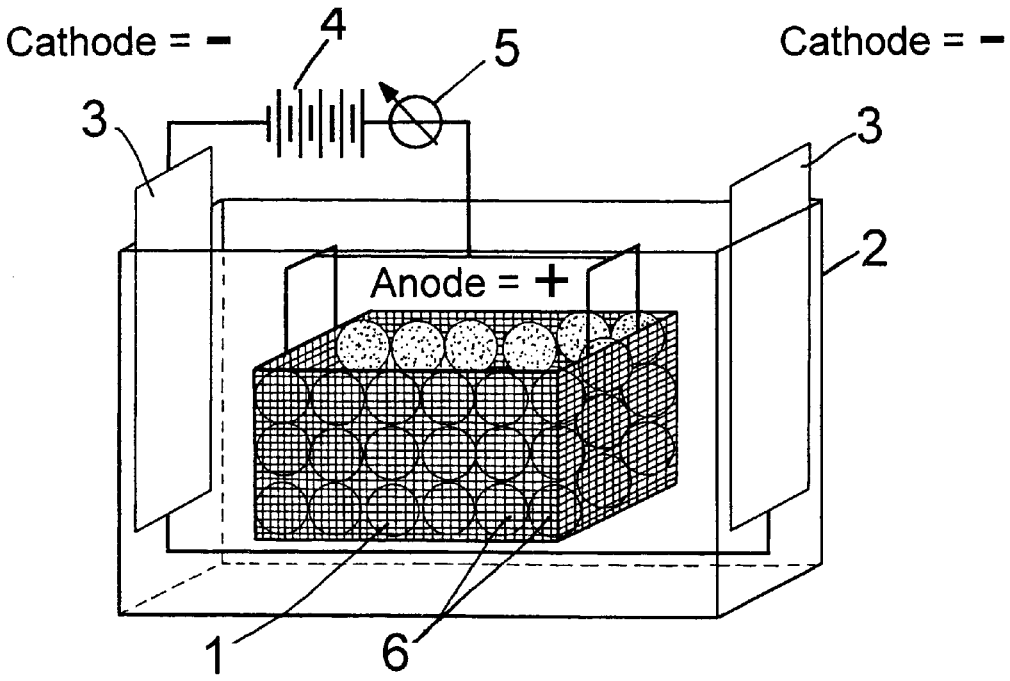
FIG. 2*a* simplified schematic view of an anodic dipcoating device according to the present invention.

In FIG. 2, only the anode and cathode have been exchanged, all other features remaining the same. FIG. 2 shows an anodic, electrophoretic enameling (AEE).

A combination of an epoxide resin, an amine and a melamine resin, which is pigmented and water dilutable, is given as an example of an enamel, which is used here. Some of the components are 1-methoxy-2-propanol, 2-butoxyethanol and 2-dimethylaminoethanol. It is a black, liquid enamel.

What is claimed is:

1. A method of electro-dipcoating of electro-conductive hardware elements, comprising the steps of providing a coating bath with at least one anode and one cathode, wherein, in case of cathodic electrophoretic enameling the anode and, in case of anodic electrophoretic enameling, the cathode is coated with an enamel which was at least one of baked, after an enameling process and subsequently activated, and coated with an electrically conductive enamel which cures subsequently at room temperature; positioning the hardware elements in or at a supporting means located in the coating bath; and effecting coating of the hardware elements.

2. The method of claim 1, wherein at least one of the anode, cathode, and the supporting means is coated with a cathodic or an anodic immersion paint, with a voltage being applied until a current no longer flows, the enamel being subsequently one of baked and cured at room temperature, and subsequently the coating of the hardware elements is effected by applying a DC or AC voltage.

3. The method of claim 2, wherein the coating is effected by applying high DC power surges.

4. The method of claim 3, wherein the coating is carried out at a DC current of 20 to 500 V and the activation is conducted with current surges of up to 1,000 V.

5. The method of claim 2, wherein the immersion paint contains electroconductive materials.

6. The method of claim 5, wherein the electroconductive materials are elected from a group consisting of graphite and metal.

7. The method of claim 1, wherein, before the enameling and the subsequent activation of the coating, the anode or cathode is initially coated with a corrosion-protecting material.

8. The method of claim 7, wherein the corrosion protecting material comprises a zinc dust paint.

9. The method of claim 1, wherein the anode or cathode is operated with a dialysis cell in the coating bath.

10. The method of claim 1, wherein at least one of the anode, cathode and supporting means is formed of plastic elements provided with metal coatings before the electrodipcoating process.

11. The method of claim 1, wherein one of a drum and a basket is used as supporting means for hardware elements, or a frame is used for suspending articles, which are to be coated.

12. The method of claim 1, wherein, for continuous processing, a coating belt is used, which was subjected to its own coating procedure with enamel, subjected to baking and a subsequent activation by current surges of high DC voltage.

13. The method of claim 1, wherein the supporting means, for their activation, is provided with densely packed electrically conductive objects.

* * * * *